US006558467B1

(12) United States Patent
Lay et al.

(10) Patent No.: US 6,558,467 B1
(45) Date of Patent: May 6, 2003

(54) TAPE DISPENSING APPARATUS WITH IMPROVED ADHESIVE REACTIVATION

(75) Inventors: Roger F. Lay, Woodbury, CT (US); Donald Barker, Sandy Hook, CT (US)

(73) Assignee: Better Packages Inc., Shelton, CT (US)

( * ) Notice: Subject to any disclaimer, the term of this patent is extended or adjusted under 35 U.S.C. 154(b) by 20 days.

(21) Appl. No.: 09/709,232

(22) Filed: Nov. 10, 2000

Related U.S. Application Data

(60) Provisional application No. 60/164,614, filed on Nov. 10, 1999.

(51) Int. Cl.[7] ..... B05C 5/00

(52) U.S. Cl. ..... 118/302; 118/325; 118/679; 156/578

(58) Field of Search ..... 118/302, 312, 118/680, 679, 325; 156/578; 83/14, 22, 24, 165; 134/198, 58 R

(56) References Cited

U.S. PATENT DOCUMENTS 1,956,862 A * 5/1934 Gantz ..... 156/385
3,970,507 A * 7/1976 Dalzell et al. ..... 156/446
4,924,805 A * 5/1990 O'Dea ..... 118/680
5,443,084 A * 8/1995 Saleur ..... 134/58 R

* cited by examiner

*Primary Examiner*—Richard Crispino
*Assistant Examiner*—Yewebdar T Tadesse
(74) *Attorney, Agent, or Firm*—Perman & Green, LLP

(57) ABSTRACT

A tape dispensing apparatus comprising a frame, a feeding mechanism, and a wetting system. The frame has a storage area for storing tape therein. The frame also has an exit area through which tape is dispensed. The feeding mechanism is connected to the frame. The feeding mechanism feeds the tape from the storage area to the exit area. The wetting system is connected to the frame for wetting a side of the tape, and activating a moisture activated adhesive on the side of the tape. The wetting system comprises a wetting head mounted to the frame. The wetting head has a moisture releasing portion. The wetting head wets the moisture activated adhesive on the side of the tape without contact between the side of the tape and the moisture releasing portion of the wetting head.

21 Claims, 3 Drawing Sheets

TAPE DISPENSING APPARATUS WITH IMPROVED ADHESIVE REACTIVATION

CROSS-REFERENCE TO RELATED APPLICATION

This application claims the benefit of U.S. Provisional Application No. 60/164,614, filed Nov. 10, 1999, which is incorporated by reference herein in its entirety.

BACKGROUND OF THE INVENTION

1. Field of the Invention

The present invention relates to tape dispensers and, more particularly, to tape dispensers for gummed tape.

2. Prior Art

Water activated gummed tape is used in, for example but not limited to, the closing and sealing of corrugated cartons. Gummed tape of a predetermined length is drawn from a tape roll, by an electromechanical means and is simultaneously drawn across wetted brushes or rollers to reactivate the adhesive. The tape is then cut to length and applied, for example, to the flaps of a carton to seal the carton. An operator may apply the tape to the carton manually using a tape dispenser, to manually feed, cut and moisten the tape. Otherwise, application of the tape to the carton may be automatic, using a case sealer to feed, cut, moisten and apply the tape to the carton.

Conventional tape dispensers and case sealers, hereinafter referred to as tape dispensers, typically apply water, or water with glue enhancing additives, hereinafter referred to as "fluid", to the tape by drawing fluid from a reservoir or tank, through brushes which are similar to paint brushes. The wetted brushes are pressed against the glue surface of the tape and generally perform two actions to reactivate the glue.

(1) the brush bristles scratch or scarify the glue surface on the gummed tape to facilitate fluid penetration into the adhesive; and (2) the wetted brush bristles convey fluid, by capillary action, to the glue causing it to be reactivated.

The physical contact of the wetted brushes with the glue and with the fluid in the reservoir causes a build up of glue on the brushes and in the reservoir or tank containing the fluid. Eventually this build up reduces the efficiency of the reactivation process, causing inadequate adhesion of the tape to the carton.

The present invention overcomes the problems of the prior art as will be described in greater detail below.

SUMMARY OF THE INVENTION

In accordance with the first embodiment of the present invention, a tape dispensing apparatus is provided. The tape dispensing apparatus comprises a frame, a feeding mechanism, and a wetting system. The frame has a storage area for storing tape therein. The frame also has an exit area through which tape is dispensed. The feeding mechanism is connected to the frame. The feeding mechanism feeds the tape from the storage area to the exit area. The wetting system is connected to the frame for wetting a side of the tape, and activating a moisture activated adhesive on the side of the tape. The wetting system comprises a wetting head mounted to the frame. The wetting head has a moisture releasing portion. The wetting head wets the moisture activated adhesive on the side of the tape without contact between the side of the tape and the moisture releasing portion of the wetting head.

BRIEF DESCRIPTION OF THE DRAWINGS

The foregoing aspects and other features of the present invention are explained in the following description, taken in connection with the accompanying drawings, wherein.

DETAILED DESCRIPTION OF THE PREFERRED EMBODIMENT

Figure 1:
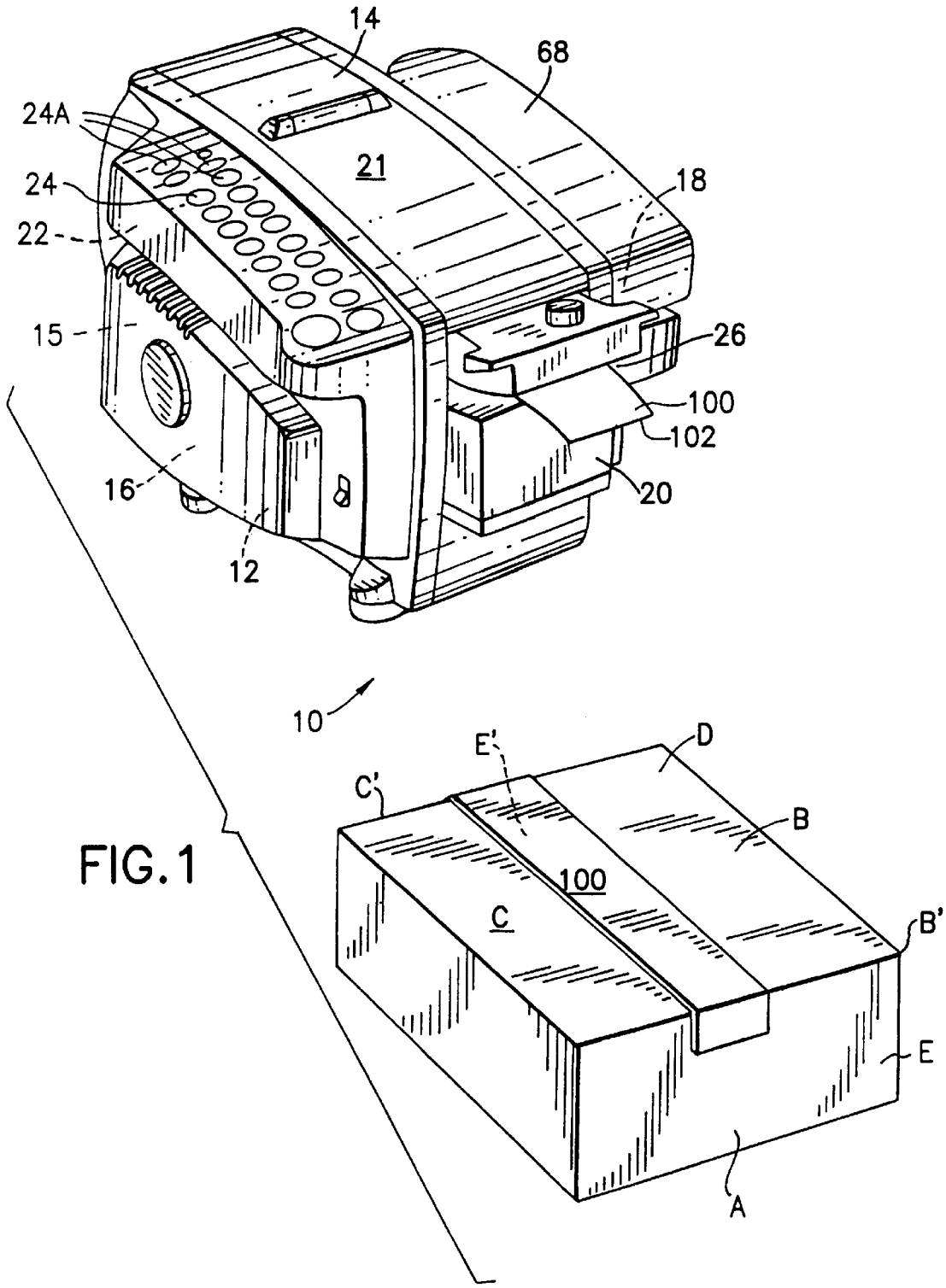
FIG. 1 is a schematic perspective view of a tape dispensing apparatus incorporating features of the present invention, and a carton.

Referring to FIG. 1, there is shown an exploded perspective view of a tape dispensing apparatus 10 incorporating features of the present invention, and a carton A sealed with tape from the tape dispensing apparatus. Although the present invention will be described with reference to the single embodiment shown in the drawings, it should be understood that the present invention can be embodied in many alternate forms of embodiments. In addition, any suitable size, shape or type of elements or materials could be used.

The carton A is shown for example purposes in FIG. 1, as having a general hexahedron shape. The carton A has at least two generally rectangular flaps B, C on at least one side D of the package. When the flaps B, C are folded closed, a seam E' is formed between the flaps. Seams B', C' are also formed between the folded flaps B, C and one or more of the adjoining sides E of the package A. In alternate embodiments, the package may be of any other suitable type or configuration, such as for example, seamed envelopes of suitable shape and size, or any other suitable containers or cartons of any other suitable shape, and having flaps forming sealable seams.

In accordance with the present invention, the tape dispensing apparatus 10 holds, and dispenses tape 100. The tape 100 is preferably gummed paper tape which has an adhesive underside 102. The adhesive on the gummed tape 100 is initially in an inactive state. When dispensed from apparatus 10, the tape 100 is cut by the tape dispensing apparatus 10 into sections, such as for example, section 100', of desired length to be used for sealing seams on packages. For example, the tape section 100' is shown in FIG. 1 being used to seal seam E' and carton A. The adhesive on the tape 100 is activated by the tape dispensing apparatus 10 so that cut sections, similar to section 100', are self-adhesive. The tape dispensing apparatus 10 may selectively activate the adhesive along different lateral sections of the tape dispensed from the tape dispensing apparatus. When the section of tape 100' is applied to carton A to close the seam E' between flaps B, C, the section of the tape with activated adhesive attaches to the carton A thereby sealing the carton A.

In accordance with a first preferred embodiment of the present invention, tape 100 may be reinforced gummed paper tape, though any suitable type of tape may be used including plastic tape and non-reinforced paper tape. The tape 100 generally has a top layer (not shown) a pressure contact layer (not shown), reinforcing strands (not shown), and a bottom layer (not shown). The top layer and bottom layer are made of suitable paper. The contact pressure layer may be a suitable adhesive which holds the top layer, the reinforcing strands and the bottom layer together. The width of the tape is preferably about 60 mm, though the present invention is equally applicable to gummed tape of any width and length. The lower surface 102 (see FIG. 1) of the tape 100 has an adhesive 104 deposited thereon. The adhesive may be deposited on the bottom of the tape after the tape is manufactured, or during the manufacture of the tape. The adhesive is preferably a moisture activated adhesive, such as for example, an organic, non-toxic adhesive with a modified corn starch, smooth coat, high tack formulation, though any other suitable organic, or non-organic adhesive may be used. The adhesive may be deposited on the bottom surface 102 by any suitable means, such as spraying, rolling, or brushing the adhesive onto the bottom layer. The adhesive on the lower surface 102 of the tape 100 is in an inactive (i.e. non-adhesive) state when the tape is manufactured. The adhesive surface 102 may then be activated by adding moisture as will be described in greater detail below.

Figure 2:
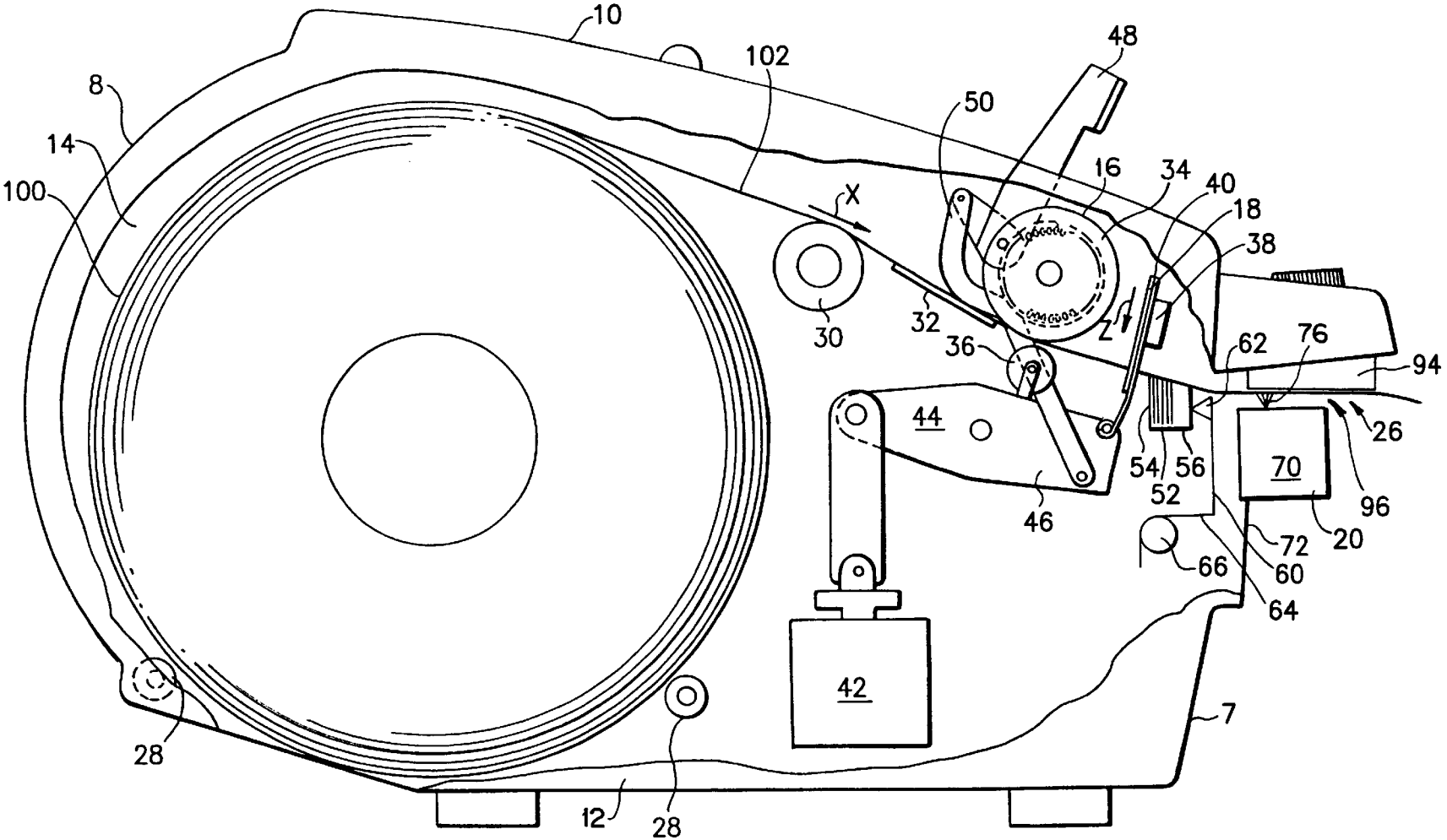
FIG. 2 is a schematic partial elevation view of the tape dispensing apparatus in FIG. 1.

Referring now also to FIG. 2, the tape dispensing apparatus 10 generally comprises a frame 12, a tape storage area 14 defined in the frame 12, a tape feeding mechanism 16, a cutting section 18, and a wetting system 20. The feeding mechanism 16, cutting section 18, and wetting system 20 are mounted to the frame 12. Housing 21 covers the frame 12. The tape dispensing apparatus 10 has an exit 26 through which tape 100 is dispensed. The tape is stored in the tape storage area 14. The feeding mechanism 16 draws tape out of the storage area and feeds it past the cutting section 18, and wetting system 20, and then to the exit 26 through which the tape is dispensed from the apparatus. The tape is cut at the cutting section 18. The wetting system 20 wets the tape to activate the moisture activated adhesive as will be described in greater detail below. Preferably, the apparatus 10 includes a programmable controller 22 which is controllably connected to the feeding mechanism 16, cutting section 18, and wetting system 20 of the apparatus 10. A user interface 24 is provided to allow a user to interface with controller 22. In the preferred embodiment, the user interface 24 has function keys 24A, used by the user to input commands, such as for example, "Start/Stop", and identifying the dispensed tape lengths, to the controller 22. In alternate embodiments, the user interface may use any other input means such as a touch display, or PC keyboard for entering commands in the controller.

The tape storage area 14 is generally located towards the rear 8 of the frame 12 though in alternate embodiments the tape may be stored in any suitable location in the frame. In the preferred embodiment, the tape storage area 14 is sized and shaped to hold tape 100 in a roll configuration. The roll may be positioned vertically in the frame. In alternate embodiments, the tape may be stored in the storage area in any other suitable configuration. The tape storage area 14 is provided with support rollers 28 which support the tape roll stored therein. The roller configuration shown in FIG. 2 is merely for example purposes, and the support rollers may be arranged in any other suitable configuration. The support rollers 28 are disposed to aid relatively unencumbered rotation of the tape roll when the feed mechanism 16 draws tape out of the storage area 14.

The feeding mechanism 16 generally comprises idler rollers 30, one or more guide trays 32, feed roller 34, pinch roller 36, and drive motor 15. The idler rollers 30 (only one idler roller 30 is shown in FIG. 2 for example purposes) are located between the tape storage area 14 and feed roller 36. The idler rollers 30 support and guide the tape in the feed direction (indicated by arrow X) to the feed rollers 34. As shown in FIG. 2, one or more guide trays 32 are mounted to the frame 12 in the proximity of the feed roller 34. The guide trays are shaped and orientated such that the tape riding upon the guide trays 32 is orientated true to the feed direction X of the feed mechanism 16, and aligned with the feed roller 34. This prevents the tape from being skewed or twisted when fed by the feed roller 34. Feed roller 34 is preferably located towards the front 7 of the apparatus 10. The feed roller 34 is drivingly connected to electric motor 15 (see FIG. 1) by suitable transmission means (not shown) such as a belt, or chain drive. When the electric motor 15 is energized, under control from controller 22, the motor rotates the feed roller 34 in a suitable direction (e.g. counterclockwise) to transport the tape in the feed direction X of the feed mechanism. Friction contact between the feed roller 34 and the tape causes the tape to move when the feed roller turns. Friction contact between the tape and feed roller 34 is enhanced in the preferred embodiment by a pinch roller 36 which is located on the opposite side of the tape from the feed roller 34 (see FIG. 2). When in the engaged position, shown in FIG. 2, (the pinch roller also has a disengaged position as will be described below) the pinch roller 36 presses the tape against the feed roller 34 thereby increasing the friction force between roller and tape. From the feed roller 34, the tape is transported to the cutting section 18, wetting system 20, and exit 26 of the apparatus 10. In the preferred embodiment, the feed roller 34 is connected to a counter 35 which can indicate the rotation of the feed roller, and hence, the amount of tape being fed, to the controller 22. The feeding mechanism 16 described above and shown in FIGS. 1–2, is merely one example of a suitable feeding mechanism which may be used in the tape dispensing apparatus of the present invention. The present invention is equally applicable to dispensing apparatus having any other suitable feeding mechanism such as for example a manually operated feeding mechanism.

The cutting section 18 of the apparatus 10 has a cutting mechanism 38. The cutting mechanism 38, which is operated by controller 22 to cut the tape 100 fed past the cutting section 18, generally comprises one or more cutting blades 40, spring loaded solenoid 42, and pivot link 44. The cutting blade 40 is slidably supported in frame 12 by guide rails (not shown). Guide rails allow the cutting blade 40 to slide, in the direction indicated by arrow Z, between an up position (shown in FIG. 2), and a down position (not shown). In the preferred embodiment, the cutting blade 40 is orientated generally transverse to the tape 100 as the tape is being fed by the feed mechanism 16 past the cutting blade 40.

Cutting blade 40 is connected by a pin to one end of pivot link 44. Pivot link 44 is pivotably mounted in the middle to frame 12. The opposite end of pivot link 44 is connected to a spring loaded solenoid 42 which moves generally up and down when the solenoid is opened and closed. The up and down motion of the solenoid 42 is transferred to the cutting blade 40 by pivot link 44 so that the cutting blade is moved up and down under control of controller 22 (see FIG. 1). By way of example, in the preferred embodiment, cutting blade 40 is initially in the down position (not shown) and the solenoid 42 is open. When the solenoid 42 is energized, under a suitable command from controller 22, solenoid 42 is closed which pivots pivot arm 44 to move the cutting blade 40 to the up position shown in FIG. 2. Deenergizing the solenoid 42 again causes the spring loaded solenoid 42 to return to its open position which, via pivot link 44, in turn moves the cutting blade 40 back to its down position. As shown in FIG. 2, pinch roller 36 of the feeding mechanism 16 may also be mounted off the pivot link 44 such that when the solenoid 42 is energized the pinch roller 36 is moved up to press the tape against the feed roller, and when the solenoid 42 is deenergized, the pinch roller 36 is moved down to release the tape (not shown). In alternate embodiments, the cutting blade may be moved up and down by any other suitable means such as directly driving the blade with a compressed air, or fluid piston.

In the preferred embodiment, the apparatus 10 may be provided further with a lift arm 48 for manually raising and lowering the cutting blade 40 in the frame 12. Lift arm 48 is pivotably connected to frame 12 so that the arm may be rotated between a lowered position and a raised position (arm 48 is shown in the raised position in FIG. 2 for example purposes). The arm 48 is connected via linkage 50 to the same end 46 of pivot link 44 to which the cutting blade 40 is connected. The cutting blade 40 may thus be raised and lowered manually by raising and lowering the lift arm 48.

Still referring to FIGS. 1–2, in the preferred embodiment, the apparatus 10 includes a dry brush 52, or brush system for scratching the adhesive on the tape 100 as the tape 100 is being fed by the feed mechanism 16 to the exit 26 of the apparatus 10. The brush may be of any suitable type with bristles 54 made from plastic, or any other suitable material. The height, and density of the bristles 54 is selected to insure that the bristles have sufficient stiffness to scratch the adhesive on the lower surface 102 of the tape 100. In the preferred embodiment, the brush 52 is held in a brush support, or tray 56 fixedly mounted to the frame 12 of the apparatus 10. The tray 56 holds the brush 52 below the tape 100. As seen in FIG. 2, the top of bristles 54 contact the lower surface 102 of tape 100. The brush 52 preferably extends across the width of the tape 100, so that, the entire lower surface 102 of the tape rubs over the brush 52 when the tape is fed by feed mechanism 16. The frame 12 may have a support shelf (not shown) over the tape 100 opposite the brush 52, which presses the tape 100 downwards against the top of brush 52. This allows the bristles 54 of the brush 52 to find purchase, and penetrate into the adhesive on the lower surface 102 of the tape, while preventing the tape from buckling as the tape is fed past the brush 52 by the feed mechanism 16. In alternate embodiments, the brush, or a number of brushes, may be mounted on a roller thereby forming a roller brush, which is pivotably connected to the frame. The roller brush may be powered by a suitable motor which rotates the roller brush to scratch the adhesive surface of the tape as it is being fed from the apparatus. In other alternate embodiments, the tap dispensing apparatus may not have a brush for scratching the adhesive on the tape. The brush tray 56 may be provided with a shelf, or chamber adjacent to the brush to collect detritus generated from the adhesive on the lower surface 102 of the tape when the brush 52 scratches the adhesive.

In the preferred embodiment, the apparatus 10 also includes a vacuum system 60 for collecting the detritus from the adhesive being scratched by brush 52. The vacuum system, generally, comprises a suitable nozzle 62, hose or tubing 64, and vacuum pump 66. The nozzle 62 is located in the apparatus 10 to draw suction immediately adjacent to the top of brush 52. The nozzle 62 which is shown schematically in FIG. 2, may be located along one edge of the brush 52, such as for example, the forward edge of the brush. Otherwise, the nozzle may be configured to form a plenum (not shown) around the top of the brush and provide vacuum suction around the brush.

The suction nozzle 62 is connected by hose or tubing 64 to vacuum pump 66. The vacuum pump 66, which may be of any suitable type, such as for example, a reciprocating, or diaphragm pump, is operated by the controller 22. The vacuum pump 66 is energized by the controller 22, thereby drawing a vacuum at the brush 52, when the solenoid 42 is energized, and the feed mechanism 16 feeds tape 100 past the brush 52. In alternate embodiments, the apparatus may not be provided with a vacuum system for collecting adhesive detritus generated by the brush rubbing against the tape.

Figure 3:
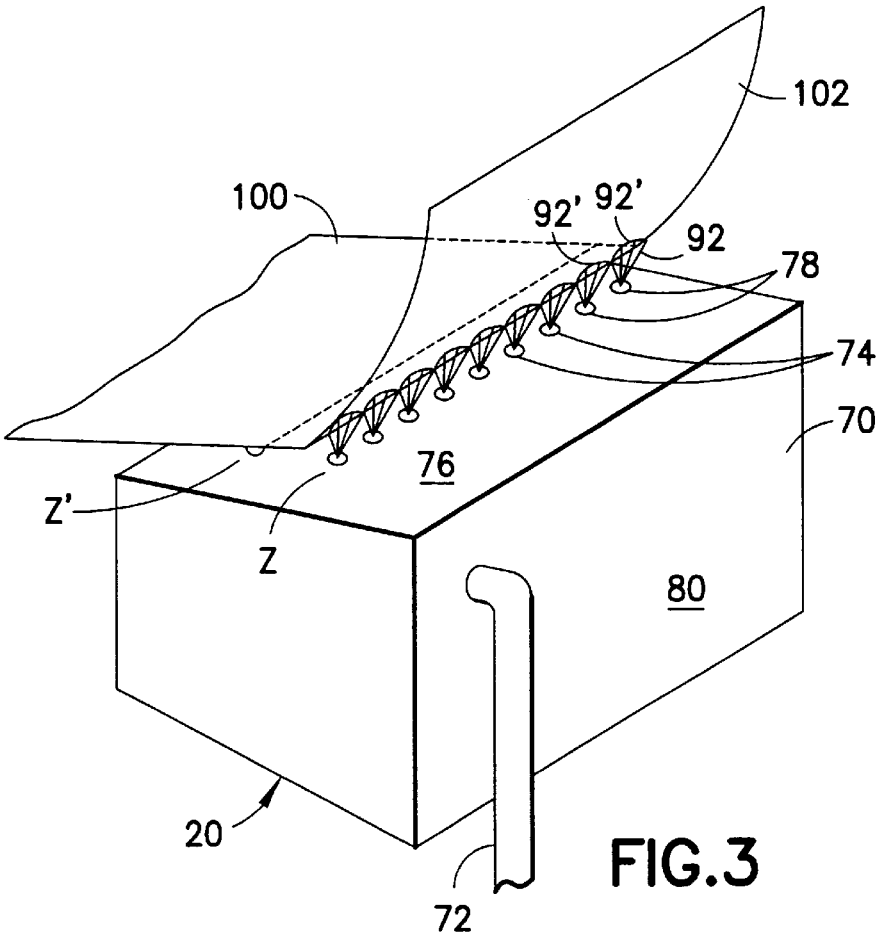
FIG. 3 is a perspective view of a tape moistening head of the tape dispensing apparatus, and a portion of tape dispensed from the dispensing apparatus.

Referring now to FIGS. 1–3, in the preferred embodiment, the wetting system 20 of the apparatus 10 generally comprises a fluid reservoir or bottle 68, a fluid feed line 72, and a tape moistening or wetting head 70. The wetting head 70 is mounted to the front 7 of the frame 12, and will be described in further detail below. The bottle 72 holds a supply of suitable adhesive wetting fluid. The wetting fluid used in the wetting system 20 will also be described in greater detail below. The bottle 68 may be mounted external to housing 21 for ease of refilling. In the preferred embodiment, the bottle 68 may also be removable. The bottle 68 is connected by fluid feed line 72 to the wetting head 70. Wetting fluid is fed to the wetting head 70 from the bottle 68 through the line 72. In the preferred embodiment, gravity feed is sufficient to maintain fluid flowing from the bottle 68 to head 70, though in alternate embodiments a suitable supply pump may be provided to augment gravity feed of wetting fluid. Feed line 72 which extends from the supply bottle 68 to the wetting head 70 may be made of any suitable tubing such as plastic, steel, or copper tubing.

Figure 4:
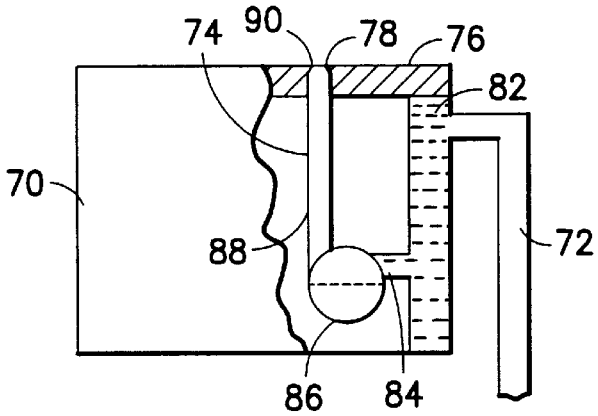
FIG. 4 is a schematic partial elevation view of the moistening head in FIG. 3.

Referring now to FIGS. 3–4, there is shown respectively a schematic perspective view, and a schematic partial cross-sectional view of the wetting head 70 of apparatus 10. The wetting head 70 generally comprises a housing 80 with fluid jets 74 located therein. The housing 80 is shown in FIG. 3 as having a generally hexahedron shape, though in alternate embodiments, the housing of the wetting head may have any other suitable shape. The housing 80 may be made of plastic, or any suitable metal such as, for example, stainless steel, or aluminum. The upper plate 76 of the housing 80 has apertures 78 formed therein through which fluid jets 74 discharge fluid. This can be seen in FIG. 3, the jet apertures 78 are preferably formed along rows Z, $Z^1$ (only two rows Z, $Z^1$ are shown in FIG. 3 for example purposes). The rows Z, $Z^1$ of apertures 78 extend along the top plate 76 of the housing so that rows Z, $Z^1$ are orientated along the width of the tape 100 being dispensed from the exit 26 (see also FIG. 1) of the apparatus 10. The jet discharge apertures 78 may have an exit diameter of about 0.015 inches, at the surface of plate 76, though in alternate embodiments, the discharge apertures of the fluid jets may have any other suitable diameter. The discharge apertures 78 in plate 76 may be spaced equally apart along rows Z, $Z^1$ at a center-to-center pitch of about 0.10 inches, though in alternate embodiments, the center-to-center pitch may be as desired. The aperture 78 in rows Z, $Z^1$ may further be aligned longitudinally in columns, or otherwise, may be staggered relative to each other. In alternate embodiments, the discharge holes may be formed in the upper plate of the housing in any other suitable patterns such as for example, in concentric circles extending radially from a center of the upper plate.

In the preferred embodiment, each aperture 78 has a corresponding fluid jet 74 which discharges fluid through that hole. FIG. 4 shows a representative fluid jet 74 connected to a representative aperture 78. The jet generally comprises an inlet or priming channel 84, a pump 86, and an output or discharge channel 88. Housing 80 preferably includes an accumulating fluid chamber 82 (see FIG. 4). Fluid may be fed into the accumulating chamber 82 from feed line 72. The accumulating chamber 82 acts as a manifold and thus provides a steady supply of fluid to all fluid jets 74, while mitigating disturbances in both pressure and flow rate of the fluid supplied from feed line 72. Priming channel 84 extends between the pump 86 and the chamber 82, and allows fluid from chamber 82 to enter the pump 86. The priming channel 84 may be located such that the head of the fluid in the chamber 82 is sufficient to flow fluid into pump 86. The pump channel 84 may be an integral channel formed in the structure of the housing 80, or may be made of suitable tubing. Pump 86 is an electro-mechanical pump such as for example, but not limited to, a positive displacement pump of sufficient capacity to pulse fluid through the discharge channel 88. By way of example, the pump may include a piezo-electric element, and membrane (not shown) to drive fluid at appropriate rates and pressures through the jet 74. Alternatively, the pump may use a spring loaded reciprocating element to generate the desired head to the fluid in the jet. The pump is controllable connected (not shown) to controller 22. The controller 22 may turn the pump 86 on and off and may also throttle the output of the pump. The pump 86 is connected to the corresponding discharge aperture 78 in the upper plate 76 of the housing 80 by discharge channel 88. Discharge channel 88 may also be an integral channel in the housing structure, or otherwise, may be made from tubing. In alternate embodiments, a number of apertures in the top plate may be connected together with a discharge manifold to one jet. In that case, a single jet may discharge through a number of discharge holes. In the preferred embodiment, the discharge channel 88 is connected directly to the corresponding aperture 78. The aperture 78 is shaped to form a fluid jet nozzle 90 (e.g. the aperture may have a tapering cross section as shown in FIG. 4) so that fluid is discharged from the exit of the aperture 78 in a spray 92 (see FIG. 3). Alternatively, the discharge channel may be connected to an independent discharge spray nozzle which protrudes through the corresponding aperture in the top plate of the housing. The spray 92 from each fluid jet 74 has a sufficient height to reach and strike the lower surface 102 of the tape 100 located over the wetting head 70. The spray 92 from adjacent fluid jets 74 form overlapping wet areas 92' across the width of the lower surface 102 of tape 100 (see FIG. 3).

The fluid used in the wetting system 20 may comprise mostly water. Some additives may be added to the fluid, such as for example, but not limited to, water softening agents, and agents to facilitate penetration of the adhesive on the tape 100. One example of an agent added to the fluid to aid fluid penetration into the adhesive is Penetron™. The viscosity of the wetting fluid with the additives added thereto is substantially similar to the viscosity of water. In alternate embodiments, the wetting fluid used in the wetting system of the apparatus may be any other type of fluid. In accordance with a second preferred embodiment of the present invention, the fluid used in the wetting system may be a suitable sprayable adhesive having a viscosity substantially similar to the viscosity of water. In that case, the wetting system of the apparatus becomes an adhesive spraying, or deposition system. Accordingly, the tape used in the apparatus may be plain paper tape without having an adhesive deposited on one side of the tape. Rather, the adhesive is deposited wet on the plain tape when the tape is dispensed by the apparatus.

The wetting head 70 may further comprise a support, such as a fixed platen, or roller (not shown) to support the tape 100 over the top 76 of the head 70 so that a gap 96 (see FIG. 2) is formed between the lower surface 102 of the tape 100 and the top of the head. As shown in FIG. 2, the frame 12 of the apparatus may also have a support tray 94 at exit 26. The support tray 94 further supports the tape 100 after it is wetted by wetting-system 20, and prevents contact between the wetted lower surface of the tape 102 and the wetting head 70.

Referring now to FIGS. 1–4, a user may dispense tape 100 from dispensing apparatus 10 as described below. As noted before, tape 100 is loaded into storage area 14 in a roll configuration. Fluid is added to wetting system 20. The user energized the apparatus 12 which initiates controller 22. Using user interface 24, the user may program the controller 22 to dispense tape 100 into sections, such as sections 100', having a desired length. The user may also program the controller 22, using user interface 24 to wet specified portions of the tape being dispensed, while leaving adjoining portions dry as will be described below. The controller 22 then opens spring loaded solenoid 42, and activates the feed system motor 15. When the solenoid 42 is opened, cutting blade 40 which is initially down, is moved by link 44 to the up position (see FIG. 2). The link 44 also raises pinch roller 36 to press tape 100 against feed roller 34. The feed system 16 operates to feed tape 100 in the feed direction X past the cutting blade 40 (see FIG. 2) which now is in the up position. The tape 100 continues in the feed direction X rubbing over brush 52 and moving to the wetting system 20. The tape is configured in the storage area 14 of the apparatus 12 so that when the tape 100 reaches the wetting head 70 of the wetting system 20, the lower surface 102 (having the moisture activated adhesive thereon) faces the top 76 of wetting head 70 (see FIG. 3). The controller 72 activates the wetting system 20 in accordance with its programming. For example, if the user selects a setting wherein the entire lower surface 102 of the tape is to be wetted, (a case shown in FIG. 3) the controller 22 energizes the pumps 86 of each fluid jet 74 in the wetting head 70. Thus as the tape is fed in feed direction X, over the wetting head, the overlapping sprays 92 of the jets 74 wet the lower surface 102. The lower surface 102 is first scratched by brush 52 before reaching the wetting head 70 (see FIG. 2). The scratches in the adhesive formed by brush 52 facilitate fluid penetration into the adhesive. The vacuum system 60 is also energized by controller 22 when the tape 100 is being fed to collect adhesive rubbed off by the brush. In the case the user selects a setting where in a longitudinal strip (not shown) of the tape 100 is to remain unwetted, the controller selectively energizes some of the pumps 86 of jets 74 having discharge orifices which correspond to the sections of the lower surface 102 which are to be wetted. The jets 74 with orifices directed at the portion/portions of the lower surface which is/are unwetted remain de-energized.

Accordingly, as the tape 100 is fed over the wetting head 70 the selected portions of the tape remain dry, while adjoining portions of the tape are wetted by the wetting system. This may, for example, facilitate removal of the tape for the purpose of opening/unsealing the carton A. When controller 22 senses, from counter 35, that the desired length of tape has been dispensed, the controller deactivates the spring loaded solenoid 42. This brings the cutting blade 40 down and cuts the tape 100 into a section such as section 100' (see also FIG. 1).

The present invention separates the two functions for reactivation of the glue performed in the prior art devices by the wetting brush. In apparatus 10 bristle brushes 52 in fixed form, or in the form of rotating bristle rollers, (not shown) are provided in apparatus 10 to scratch the glue and aid fluid penetration. Optionally a vacuum device may be attached in the proximity of the brush or roller to capture glue powder as it is scratched away from the tape 100. A non contacting moistening head 70 is located after the brushes 52 to apply an electronically controlled quantity of fluid, adequate to reactivate the tape glue on the tape 100. This invention may be used in, but is not limited to use in, both tape dispensers and case sealers, providing accurately controlled tape glue reactivation without contamination that typically reduces efficiency and requires time consuming clean-up.

It should be understood that the foregoing description is only illustrative of the invention. Various alternatives and modifications can be devised by those skilled in the art without departing from the invention. Accordingly, the present invention is intended to embrace all such alternatives, modifications and variances which fall within the scope of the appended claims.

What is claimed is:

1. A gummed tape dispensing apparatus comprising:

a frame with a storage area for storing gummed tape therein, and having an exit area through which gummed tape is dispensed;

a feeding mechanism connected to the frame, the feeding mechanism feeding the gummed tape from the storage area to the exit area; and a wetting system connected to the frame for wetting a side of the tape and activating a moisture activated adhesive on the side of the gummed tape so that the gummed tape is dispensed with activated adhesive;

wherein the wetting system comprises a wetting head mounted to the frame, the wetting head having a moisture releasing portion, and wherein when the gummed tape is dispensed from the exit area, the wetting head wets the moisture activated adhesive on the side of the gummed tape without contact between the side of the gummed tape and the moisture releasing portion of the wetting head.

2. A tape dispensing apparatus in accordance with claim 1, further comprising a controller mounted to the frame for electronically controlling the wetting head.

3. A tape dispensing apparatus in accordance with claim 1, wherein the wetting head sprays wetting fluid on the side of the tape.

4. The tape dispensing apparatus in accordance with claim 1, wherein the wetting head has a wetting surface with wetting holes formed therein through which wetting fluid is sprayed on to the side of the tape.

5. The tape dispensing apparatus in accordance with claim 4, wherein wetting fluid sprayed through a number of the wetting holes is controlled independently from wetting fluid sprayed through other wetting holes in the wetting surface of the wetting head.

6. The tape dispensing apparatus in accordance with claim 1, further comprising a vacuum system mounted to the frame.

7. A tape dispensing apparatus comprising:

a frame with a storage area for storing tape therein, and having an exit area through which tape is dispensed;

a feeding mechanism connected to the frame, the feeding mechanism feeding the tape from the storage area to the exit area;

a wetting system connected to the frame for wetting a side of the tape and activating a moisture activated adhesive on the side of the tape, wherein the wetting system comprises a wetting head mounted to the frame, the wetting head having a moisture releasing portion, and wherein the wetting head wets the moisture activated adhesive on the side of the tape without contact between the side of the tape and the moisture releasing portion of the wetting head;

a vacuum system mounted to the frame; and a scratching device mounted to the frame for scratching adhesive on the tape.

8. The tape dispensing apparatus in accordance with claim 7, wherein the scratching device comprises a brush disposed on the frame to scratch adhesive on the tape before the tape is wetted by the wetting system.

9. The tape dispensing apparatus in accordance with claim 8, wherein the vacuum system has an inlet for suctioning detritus generated by the brush scratching adhesive on the tape.

10. A gummed tape dispensing apparatus comprising:

a frame having an exit area through which gummed tape is dispensed;

a wetting system connected to the frame for wetting a side of the gummed tape when exiting the apparatus through the exit area; and a programmable controller controllably connected to the wetting system for controlling the wetting system wetting the side of the tape.

11. The tape dispensing apparatus in accordance with claim 10, wherein the programmable controller is programmed to selectively turn at least one portion of the wetting system on and off for selectively and substantially simultaneously providing predetermined wetted and unwetted sections on the side of the tape.

12. The tape dispensing apparatus in accordance with claim 11, wherein the predetermined wetted and unwetted section define longitudinally adjoining strips on the side of the tape.

13. The tape dispensing apparatus in accordance with claim 10, wherein the wetting system comprises a wetting head with wetting jets for wetting the side of the tape.

14. The tape dispensing apparatus in accordance with claim 13, wherein the programmable controller is controllably connected to the wetting head for selectively turning on and off at least one of the wetting jets.

15. A tape dispensing apparatus comprising:

a frame having an exit area through which tape is dispensed;

a wetting system connected to the frame for wetting a side of the tape;

a programmable controller controllably connected to the wetting system for controlling the wetting system wetting the side of the tape; and a vacuum system mounted to the frame for suctioning the tape, and a brush mounted to the frame for scratching adhesive on the tape before the wetting system wets the tape.

16. A tape dispensing apparatus comprising:

a frame having an opening for dispensing tape from the tape dispensing apparatus; and an adhesive activation system mounted to the frame for providing a side of the tape dispensed from the opening with active adhesive thereon, the adhesive activation system having a head forming active adhesive on the side of the tape, wherein the side of the tape is disposed at a standoff from the head and a gap is formed between the side of the tape and the head, and the adhesive activation system forms activated adhesive on the side of the tape exiting the apparatus.

17. The tape dispensing apparatus in accordance with claim 16, wherein the head forms active adhesive on the side of the tape across the gap between the side of the tape and head.

18. The tape dispensing apparatus in accordance with claim 16, wherein the head is mounted on the frame proximate the opening through which tape is dispensed from the tape dispensing apparatus.

19. The tape dispensing apparatus in accordance with claim 16, further comprising a programmable controller mounted to the frame and controllably connected to the adhesive activation system for operating the adhesive activation system.

20. The tape dispensing apparatus in accordance with claim 19, wherein the adhesive activation system is at least one of an adhesive moistening system, or an adhesive deposition system.

21. The tape dispensing apparatus in accordance with claim 19, wherein the programmable controller is programmed to selectively turn the adhesive activation system on and off for providing selected sections of tape dispensed from the tape dispensing apparatus with active adhesive, other selected sections of tape dispensed from the tape dispensing apparatus having inactive adhesive.

* * * * *